US010386068B2

(12) United States Patent
Kostka, Jr. et al.

(10) Patent No.: US 10,386,068 B2
(45) Date of Patent: Aug. 20, 2019

(54) COOLING A QUENCH APERTURE BODY OF A COMBUSTOR WALL

(71) Applicant: United Technologies Corporation, Farmington, CT (US)

(72) Inventors: Stanislav Kostka, Jr., Shrewsbury, MA (US); Frank J. Cunha, Avon, CT (US)

(73) Assignee: United Technologies Corporation, Farmington, CT (US)

( * ) Notice: Subject to any disclaimer, the term of this patent is extended or adjusted under 35 U.S.C. 154(b) by 370 days.

(21) Appl. No.: 15/038,774

(22) PCT Filed: Dec. 3, 2014

(86) PCT No.: PCT/US2014/068381
§ 371 (c)(1),
(2) Date: May 24, 2016

(87) PCT Pub. No.: WO2015/084963
PCT Pub. Date: Jun. 11, 2015

(65) Prior Publication Data

US 2016/0377289 A1 Dec. 29, 2016

Related U.S. Application Data

(60) Provisional application No. 61/912,869, filed on Dec. 6, 2013.

(51) Int. Cl.
*F23R 3/00* (2006.01)
*F23R 3/04* (2006.01)
(Continued)

(52) U.S. Cl.
CPC ..... *F23R 3/005* (2013.01); *F23R 3/002* (2013.01); *F23R 3/04* (2013.01); *F23R 3/06* (2013.01);
(Continued)

(58) Field of Classification Search
CPC ..... F05D 2240/15; F23R 3/002; F23R 3/005; F23R 3/007; F23R 3/04; F23R 3/045;
(Continued)

(56) References Cited

U.S. PATENT DOCUMENTS 3,656,297 A * 4/1972 Monk ..... B25C 1/123 297/19
4,132,066 A 1/1979 Austin, Jr. et al.
(Continued)

FOREIGN PATENT DOCUMENTS

WO 8806257 8/1988
WO 2015147929 10/2015

OTHER PUBLICATIONS

Extended EP Search Report dated Nov. 8, 2016.

*Primary Examiner* — Scott J Walthour
(74) *Attorney, Agent, or Firm* — O'Shea Getz P.C.

(57) ABSTRACT

An assembly is provided for a turbine engine. A combustor wall of the turbine engine assembly includes a shell, a heat shield and an annular body. The annular body extends through the combustor wall. The annular body at least partially defines a quench aperture along a centerline through the combustor wall. The annular body defines a first cooling aperture fluidly coupled between a cooling cavity and the quench aperture. The cooling cavity is between the shell and the heat shield.

19 Claims, 10 Drawing Sheets

(51) Int. Cl.
*F23R 3/06* (2006.01)
*F23R 3/50* (2006.01)

(52) U.S. Cl.
CPC ..... *F23R 3/50* (2013.01); *F05D 2240/35* (2013.01); *F23R 2900/00017* (2013.01); *F23R 2900/03042* (2013.01); *F23R 2900/03044* (2013.01)

(58) Field of Classification Search
CPC ..... F23R 3/06; F23R 3/16; F23R 3/44; F23R 3/46; F23R 3/50; F23R 3/52; F23R 3/54; F23R 3/58; F23R 2900/03041; F23R 2900/03042; F23R 2900/03044
See application file for complete search history.

(56) References Cited

U.S. PATENT DOCUMENTS 4,265,085 A 5/1981 Fox et al.
4,820,097 A * 4/1989 Maeda ..... F02K 1/80 165/134.1
5,461,866 A 10/1995 Sullivan et al.
5,486,093 A * 1/1996 Auxier ..... F01D 5/186 416/97 R
5,687,572 A * 11/1997 Schrantz ..... F23R 3/007 431/352
5,758,503 A 6/1998 DuBell et al.
7,093,441 B2 8/2006 Burd et al.
7,146,815 B2 12/2006 Burd
8,443,610 B2 5/2013 Hoke et al.
2002/0116929 A1* 8/2002 Snyder ..... F23R 3/002 60/740
2003/0182942 A1 10/2003 Gerendas
2004/0006995 A1 1/2004 Snyder
2010/0119377 A1* 5/2010 Tibbott ..... F01D 5/186 416/97 R
2010/0251723 A1 10/2010 Chen et al.
2010/0287941 A1 11/2010 Kim et al.
2011/0048024 A1 3/2011 Snyder et al.
2011/0120132 A1* 5/2011 Rudrapatna ..... F02C 7/264 60/752
2011/0185735 A1 8/2011 Snyder
2011/0311369 A1* 12/2011 Ramachandran ..... F01D 5/186 416/97 R
2012/0297778 A1 11/2012 Rudrapatna et al.
2014/0033723 A1* 2/2014 Doerr ..... F23R 3/007 60/737

* cited by examiner

COOLING A QUENCH APERTURE BODY OF A COMBUSTOR WALL

CROSS-REFERENCE TO RELATED APPLICATION

This application claims priority to PCT Patent Application No. PCT/US14/068381 filed Dec. 3, 2014, which claims priority to U.S. Provisional Patent Appln. No. 61/912,869 filed Dec. 6, 2013, which are hereby incorporated herein by reference in their entireties.

BACKGROUND OF THE INVENTION

1. Technical Field

This disclosure relates generally to a turbine engine and, more particularly, to a combustor of a turbine engine.

2. Background Information

A floating wall combustor for a turbine engine typically includes a bulkhead, an inner combustor wall and an outer combustor wall. The bulkhead extends radially between the inner and the outer combustor walls. Each combustor wall includes a shell and a heat shield that defines a respective radial side of a combustion chamber. Cooling cavities extend radially between the heat shield and the shell. These cooling cavities fluidly couple impingement apertures defined in the shell with effusion apertures defined in the heat shield.

Each combustor wall may also include a plurality of quench aperture grommets located between the shell and the heat shield. Each of the quench aperture grommets defines a respective quench aperture radially through the combustor wall. The quench aperture grommets as well as adjacent portions of the heat shield are typically subject to relatively high temperatures during engine operation, which can induce relatively high thermal stresses within the grommets and the heat shield.

There is a need in the art for an improved turbine engine combustor.

SUMMARY OF THE DISCLOSURE

According to an aspect of the invention, an assembly is provided for a turbine engine. A combustor wall of the turbine engine assembly includes a shell, a heat shield and an annular body. The annular body extends through the combustor wall. The annular body at least partially defines a quench aperture along a centerline through the combustor wall. The annular body defines a first cooling aperture fluidly coupled between a cooling cavity and the quench aperture. The cooling cavity is between the shell and the heat shield.

According to another aspect of the invention, another assembly is provided for a turbine engine. A combustor wall of the turbine engine assembly includes a shell, a heat shield and an annular body. The annular body extends laterally between an inner surface and an outer surface. The inner surface at least partially defines a quench aperture along a centerline through the combustor wall. The outer surface is vertically between the heat shield and the shell. A cooling aperture, defined by the annular body, extends through the annular body from the outer surface to the inner surface.

According to another aspect of the invention, a grommet is provided for a combustor wall. The grommet includes an annular body, which includes an annular land. The annular land has an inner surface which at least partially defines a quench aperture through the combustor wall along a centerline. The annular land defines a cooling aperture that extends through the annular body and is fluidly coupled with the quench aperture.

The annular body may extend laterally between the inner surface and an outer surface. The annular body may include an annular rim that extends vertically from the land. The cooling aperture may extend through the annular body from the outer surface to the inner surface.

The body may include an annular land and an annular rim. The land may define the first cooling aperture and may be connected to the panel base. The rim may extend vertically from the land.

The cooling aperture may be one of a plurality of cooling apertures that extend through the annular body and that are fluidly coupled with the quench aperture.

The first cooling aperture may be one of a plurality of first cooling apertures defined by the body. Each of the first cooling apertures may be fluidly coupled between the cooling cavity and the quench aperture.

At least an outlet portion or the entire first cooling aperture may extend substantially radially relative to the centerline of the quench aperture.

At least an outlet portion or the entire first cooling aperture may extend substantially tangentially relatively to a surface of the body that defines the quench aperture; e.g., the inner surface.

At least an outlet portion or the entire first cooling aperture may extend along a centerline that is acutely angled relative to a surface of the body that defines the quench aperture; e.g., the inner surface.

The first cooling aperture may extend along a substantially straight centerline.

The first cooling aperture may extend along a curved and/or compound centerline.

The annular body may include an annular land and an annular rim. The land may extend from the heat shield and may engage the shell. The rim may extend from the land into or through an aperture defined by the shell. The land may define the first cooling aperture.

The shell may include a surface that further defines the quench aperture through the combustor wall.

The cooling cavity may fluidly couple one or more second cooling apertures defined by the shell with the first cooling aperture and one or more third cooling apertures defined by the heat shield.

The heat shield may include a plurality of panels. These panels may be attached to the shell. The body may be connected to one of the panels.

A combustor bulkhead may extend between the combustor wall and a second combustor wall. The heat shield, the second combustor wall and the combustor bulkhead may define a combustion chamber.

The foregoing features and the operation of the invention will become more apparent in light of the following description and the accompanying drawings.

DETAILED DESCRIPTION OF THE INVENTION

Figure 1:
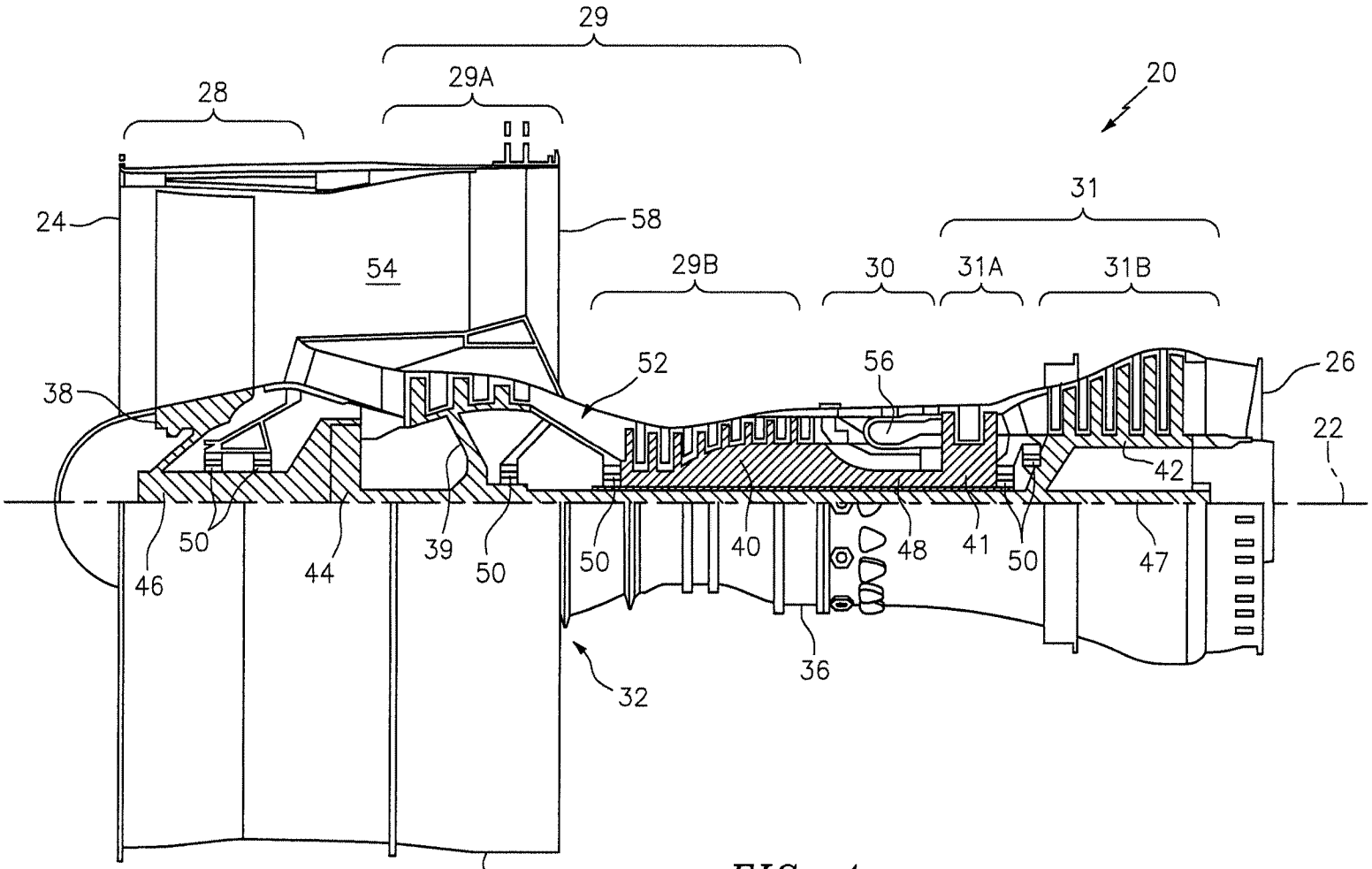
FIG. 1 is a side cutaway illustration of a geared turbine engine.

FIG. 1 is a side cutaway illustration of a geared turbine engine 20. The turbine engine 20 extends along an axial centerline 22 between a forward and upstream airflow inlet 24 and an aft and downstream airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-31 are arranged sequentially along the centerline 22 within an engine housing 32, which includes a first engine case 34 and a second engine case 36.

Each of the engine sections 28, 29A, 29B, 31A and 31B includes a respective rotor 38-42. Each of the rotors 38-42 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 38 is connected to a gear train 44 through a fan shaft 46. The gear train 44 and the LPC rotor 39 are connected to and driven by the LPT rotor 42 through a low speed shaft 47. The HPC rotor 40 is connected to and driven by the HPT rotor 41 through a high speed shaft 48. The shafts 46-48 are rotatably supported by a plurality of bearings 50. Each of the bearings 50 is connected to the second engine case 36 by at least one stationary structure such as, for example, an annular support strut.

Air enters the turbine engine 20 through the airflow inlet 24, and is directed through the fan section 28 and into an annular core gas path 52 and an annular bypass gas path 54. The air within the core gas path 52 may be referred to as "core air". The air within the bypass gas path 54 may be referred to as "bypass air".

The core air is directed through the engine sections 29-31 and exits the turbine engine 20 through the airflow exhaust 26. Within the combustor section 30, fuel is injected into a combustion chamber 56 and mixed with the core air. This fuel-core air mixture is ignited to power the turbine engine 20 and provide forward engine thrust. The bypass air is directed through the bypass gas path 54 and out of the turbine engine 20 through a bypass nozzle 58 to provide additional forward engine thrust. Alternatively, the bypass air may be directed out of the turbine engine 20 through a thrust reverser to provide reverse engine thrust.

Figure 2:
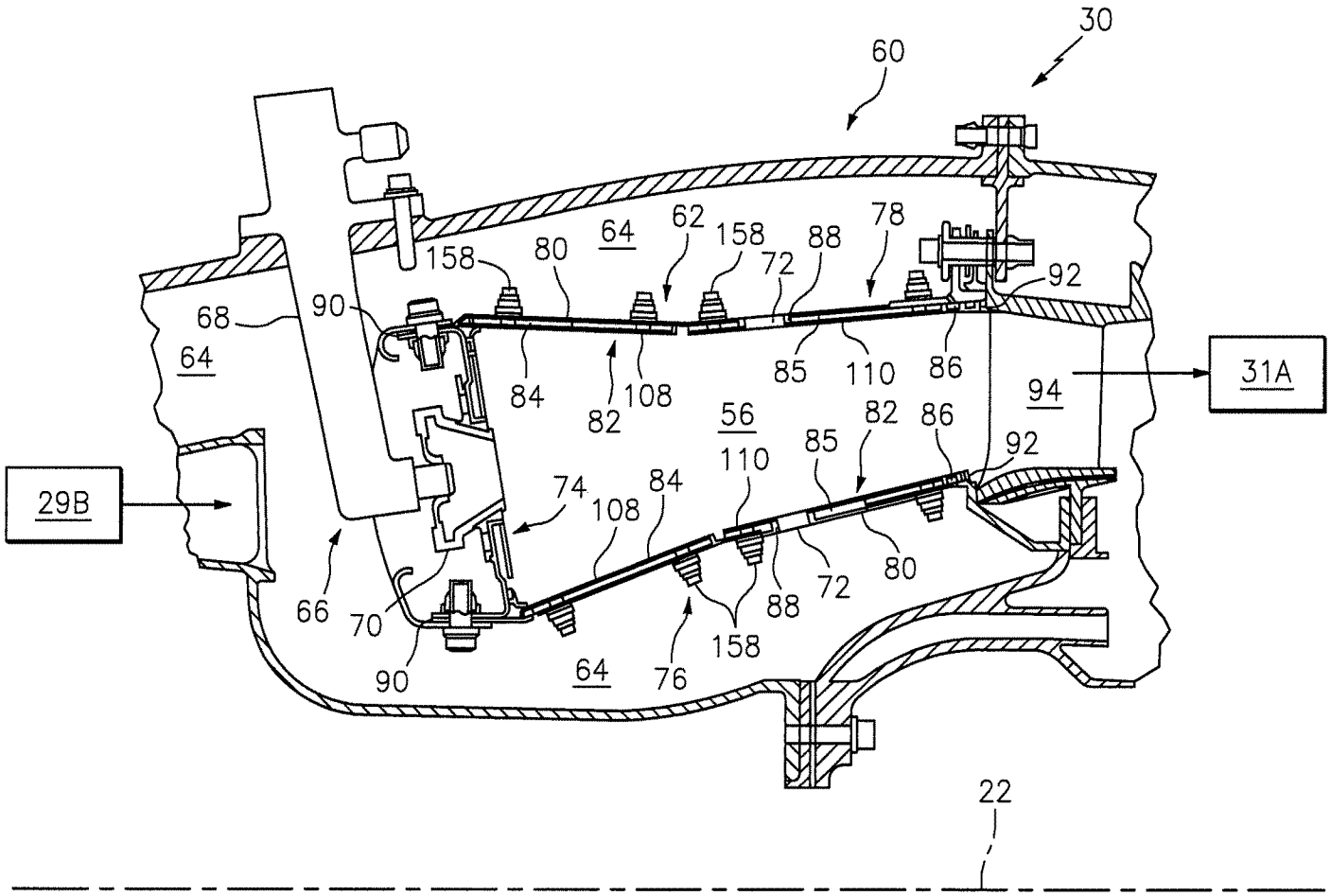
FIG. 2 is a side cutaway illustration of a portion of a combustor section.

FIG. 2 illustrates an assembly 60 of the turbine engine 20. The turbine engine assembly 60 includes a combustor 62 disposed within a plenum 64 of the combustor section 30. This plenum 64 receives compressed core air from the HPC section 29B, and provides the received core air to the combustor 62 as described below in further detail.

Figure 3:
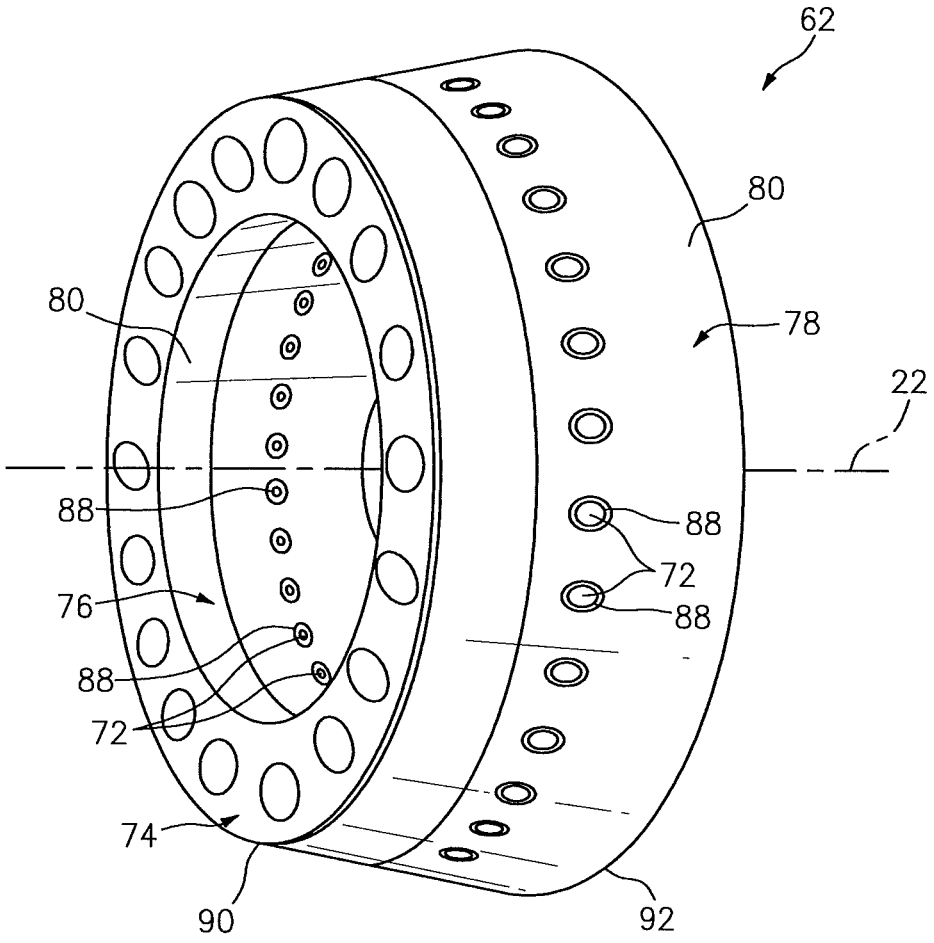
FIG. 3 is a perspective illustration of a portion of a combustor.

The turbine engine assembly 60 also includes one or more fuel injector assemblies 66. Each fuel injector assembly 66 may include a fuel injector 68 mated with a swirler 70. The fuel injector 68 injects the fuel into the combustion chamber 56. The swirler 70 directs some of the core air from the plenum 64 into the combustion chamber 56 in a manner that facilitates mixing the core air with the injected fuel. One or more igniters (not shown) ignite the fuel-core air mixture. Quench apertures 72 (see also FIG. 3) in walls of the combustor 62 direct additional core air into the combustion chamber 56 to quench (e.g., stoichiometrically lean) the ignited fuel-core air mixture.

The combustor 62 may be configured as an annular floating wall combustor. The combustor 62 of FIGS. 2 and 3, for example, includes an annular combustor bulkhead 74, a tubular combustor inner wall 76, and a tubular combustor outer wall 78. The bulkhead 74 extends radially between and is connected to the inner wall 76 and the outer wall 78. The inner wall 76 and the outer wall 78 each extends axially along the centerline 22 from the bulkhead 74 towards the HPT section 31A, thereby defining the combustion chamber 56.

Figure 4:
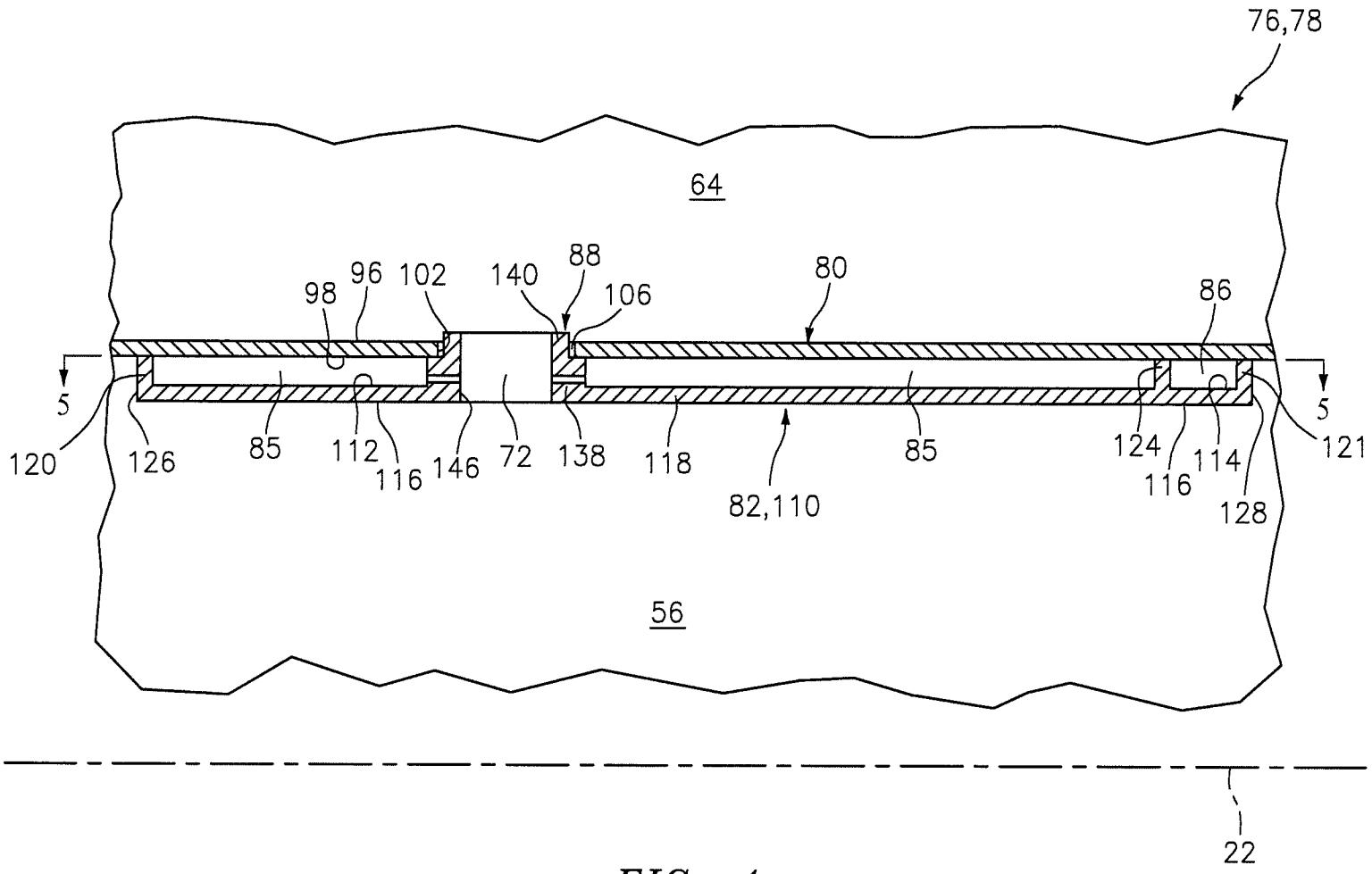
FIG. 4 is a side sectional illustration of a portion of a combustor wall.
Figure 5:
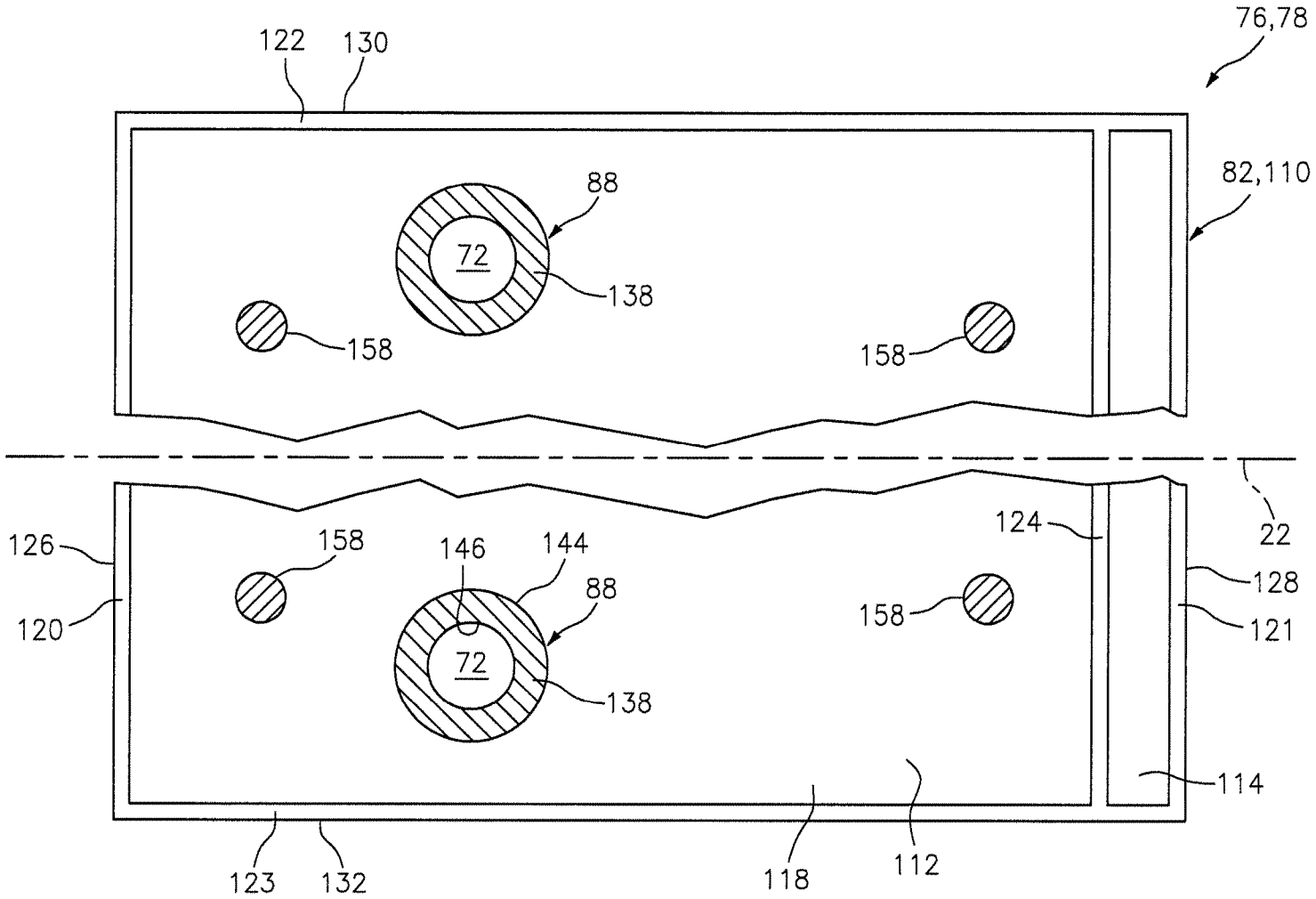
FIG. 5 is a circumferential sectional illustration of a portion of the combustor wall of FIG. 4.
Figure 6:
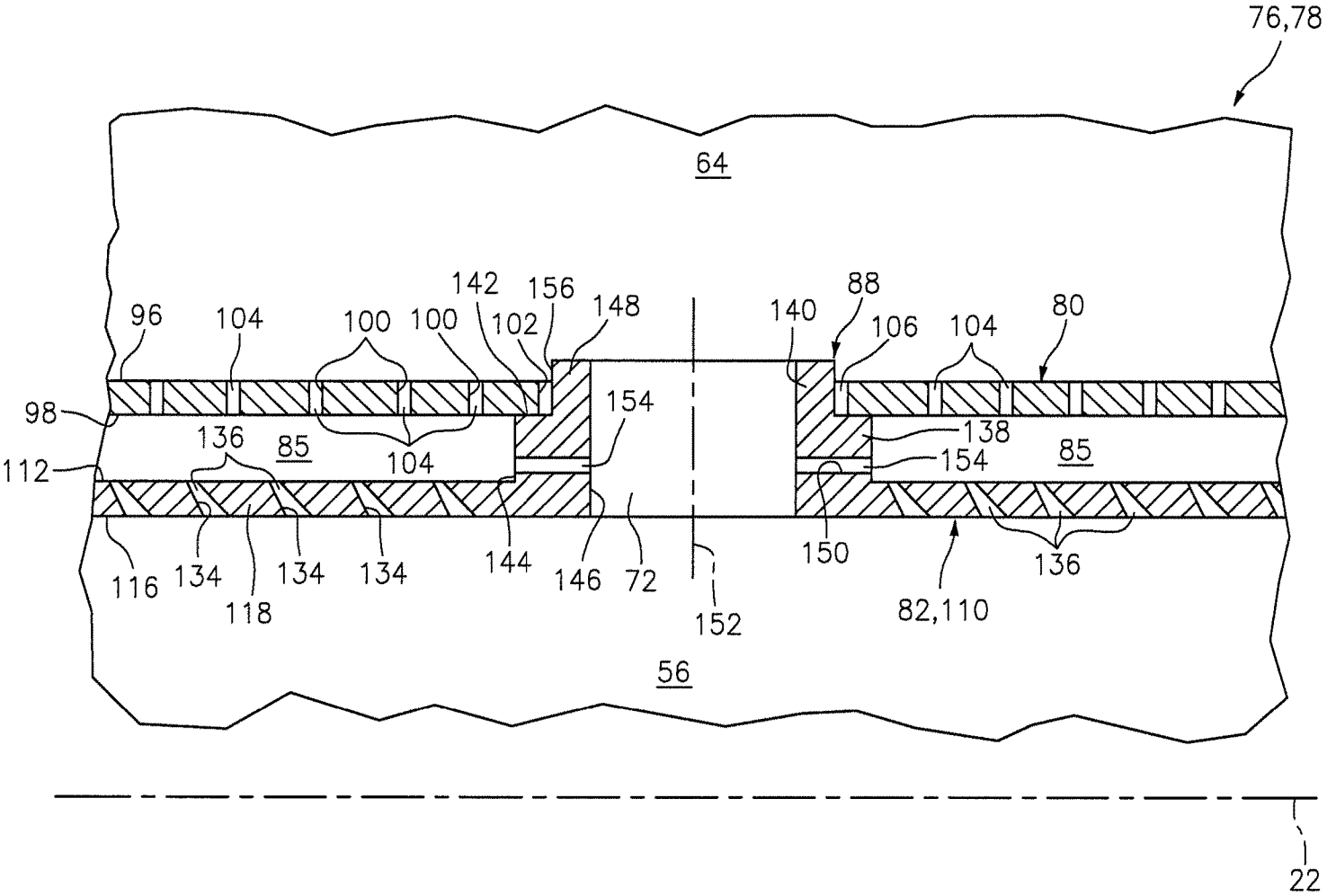
FIG. 6 is a detailed side sectional illustration of a portion of the combustor wall of FIG. 4.
Figure 7:
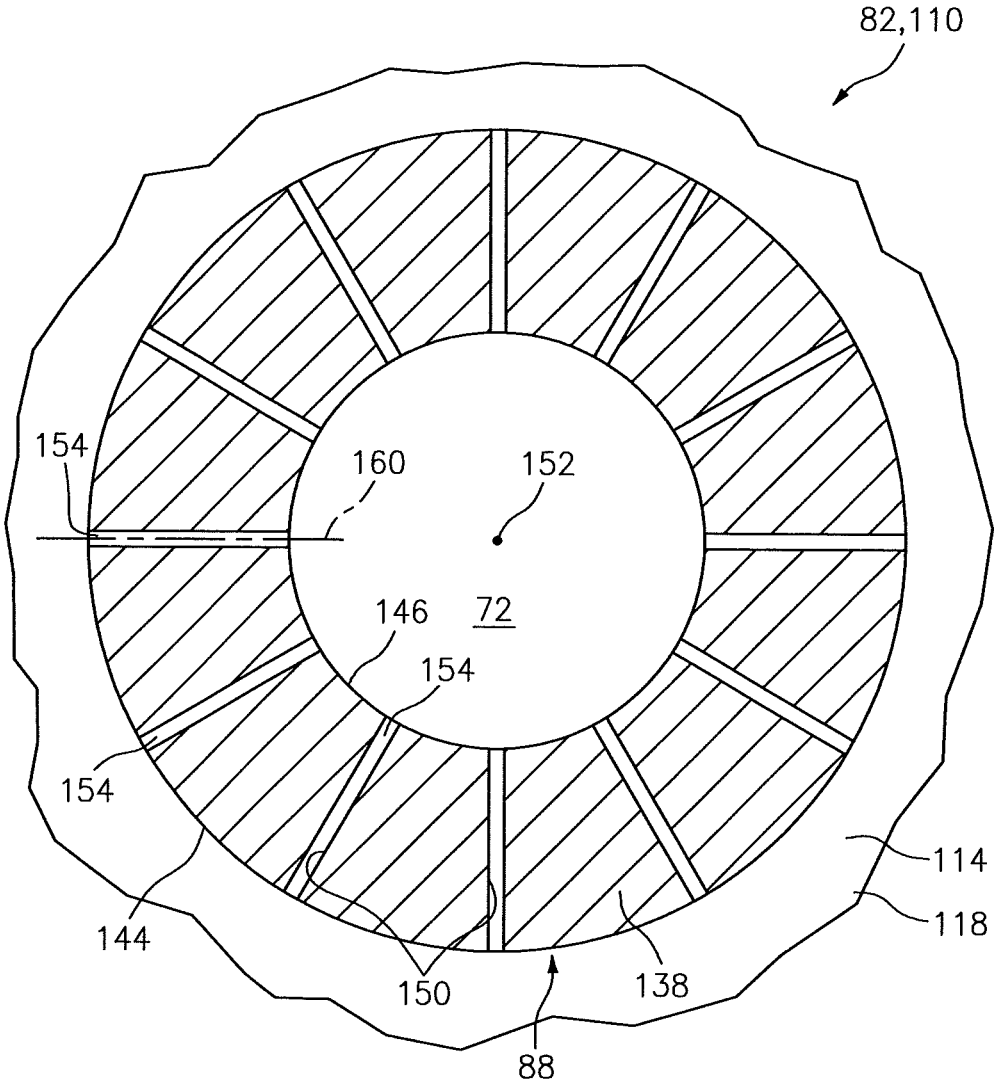
FIG. 7 is a detailed top sectional illustration of a portion of the combustor wall of FIG. 6.

FIG. 4 is a side sectional illustration of an exemplary downstream portion of one of the combustor walls 76, 78. FIG. 5 is a circumferential sectional illustration of a portion of the combustor wall 76, 78 of FIG. 4. FIG. 6 is a detailed side sectional illustration of a portion of the combustor wall 76, 78 of FIG. 4. FIG. 7 is a detailed top sectional illustration of a portion of the combustor wall 76, 78 of FIG. 6. It should be noted that some details of the combustor wall 76, 78 shown in FIGS. 6 and 7 are not shown in FIGS. 2, 4 and 5 for ease of illustration.

Referring to FIGS. 2 and 4-7, each combustor wall 76, 78 may each be configured as a multi-walled structure; e.g., a hollow dual-walled structure. Each combustor wall 76, 78 of FIGS. 2 and 4-7, for example, includes a tubular combustor shell 80, a tubular combustor heat shield 82, and one or more cooling cavities 84-86 (e.g., impingement cavities) between the shell 80 and the heat shield 82. Each combustor wall 76, 78 may also include one or more annular quench aperture bodies 88 (e.g., grommets). These quench aperture bodies 88 are disposed circumferentially around the centerline 22. Each quench aperture body 88 partially or completely defines a respective one of the quench apertures 72 (see also FIG. 3) as described below in further detail.

Referring to FIG. 2, the shell 80 extends circumferentially around the centerline 22. The shell 80 extends axially along the centerline 22 between an axial forward end 90 and an axial aft end 92. The shell 80 is connected to the bulkhead 74 at the forward end 90. The shell 80 may be connected to a stator vane assembly 94 or the HPT section 31A at the aft end 92.

Referring to FIGS. 4 and 6, the shell 80 has an exterior surface 96, an interior surface 98, one or more aperture surfaces 100, and one or more aperture surfaces 102. At least a portion of the shell 80 extends (e.g., radially) between the shell exterior surface 96 and the shell interior surface 98. The shell exterior surface 96, which may also be referred to as a plenum surface, defines a portion of a boundary of the plenum 64. The shell interior surface 98, which may also be referred to as a cavity surface, defines a portion of a boundary of one or more of the cavities 84-86 (see FIG. 2).

Referring to FIG. 6, the aperture surfaces 100 may be arranged in one or more arrays disposed along the centerline 22. The aperture surfaces 100 in each array may be arranged circumferentially around the centerline 22. Each of the aperture surfaces 100 defines a cooling aperture 104. This cooling aperture 104 extends vertically (e.g., radially) through the shell 80 from the shell exterior surface 96 to the shell interior surface 98. The cooling aperture 104 may be configured as an impingement aperture. Each aperture surface 100 of FIG. 6, for example, is configured to direct a jet of cooling air to impinge (e.g., substantially perpendicularly) against the heat shield 82.

The aperture surfaces 102 may be arranged circumferentially around the centerline 22. Each aperture surface 102 defines an aperture 106 for receiving a respective one of the quench aperture bodies 88. Each aperture 106 extends vertically through the shell 80 from the shell exterior surface 96 to the shell interior surface 98.

Referring to FIG. 2, the heat shield 82 extends circumferentially around the centerline 22. The heat shield 82 extends axially along the centerline 22 between an axial forward end and an axial aft end. The forward end is located at (e.g., on, adjacent or proximate) an interface between the combustor wall 76, 78 and the bulkhead 74. The aft end may be located at an interface between the combustor wall 76, 78 and the stator vane assembly 94 or the HPT section 31A.

The heat shield 82 may include one or more heat shield panels 108 and 110, one or more of which may have an arcuate geometry. The panels 108 and 110 are respectively arranged at discrete locations along the centerline 22. The panels 108 are disposed circumferentially around the centerline 22 and form a forward hoop. The panels 110 are disposed circumferentially around the centerline 22 and form an aft hoop. Alternatively, the heat shield 82 may be configured from one or more tubular bodies.

Referring to FIGS. 4 and 5, each of the panels 110 has one or more interior surfaces 112 and 114 and an exterior surface 116. At least a portion of the panel 110 extends (e.g., radially) between the interior surfaces 112 and 114 and the exterior surface 116. Each interior surface 112, which may also be referred to as a cavity surface, defines a portion of a boundary of a respective one of the cooling cavities 85. Each interior surface 114, which may also be referred to as a cavity surface, defines a portion of a boundary of a respective one of the cooling cavities 86. The exterior surface 116, which may also be referred to as a chamber surface, defines a portion of the combustion chamber 56.

Each panel 110 includes a panel base 118 and one or more rails 120-124. The panel base 118 and the panel rails 120 and 122-124 may collectively define the interior surface 112. The panel base 118 and the panel rails 121-124 may collectively define the interior surface 114. The panel base 118 may define the exterior surface 116.

The panel base 118 may be configured as a generally curved (e.g., arcuate) plate. The panel base 118 extends axially between an axial forward end 126 and an axial aft end 128. The panel base 118 extends circumferentially between opposing circumferential ends 130 and 132.

The panel rails may include one or more axial end rails 120 and 121 and one more circumferential end rails 122 and 123. The panel rails may also include at least one axial intermediate rail 124. Each of the panel rails 120-124 of the inner wall 76 extends radially in from the respective panel base 118; see FIG. 2. Each of the panel rails 120-124 of the outer wall 78 extends radially out from the respective panel base 118; see FIG. 2.

The axial end and intermediate rails 120, 121 and 124 extend circumferentially between and are connected to the circumferential end rails 122 and 123. The axial end rail 120 is arranged at (e.g., on, adjacent or proximate) the forward end 126. The axial end rail 121 is arranged at the aft end 128. The axial intermediate rail 124 is disposed axially between the axial end rails 120 and 121, for example, proximate the aft end 128. The circumferential end rail 122 is arranged at the circumferential end 130. The circumferential end rail 123 is arranged at the circumferential end 132.

Referring to FIG. 6, each panel 110 may also have one or more aperture surfaces 134. These aperture surfaces 134 may be respectively arranged in one or more arrays disposed along the centerline 22. The aperture surfaces 134 in each array may be disposed circumferentially around the centerline 22. Each of the aperture surfaces 134 defines a cooling aperture 136 in the panel 110 and, thus, the heat shield 82. This cooling aperture 136 may extend vertically and/or laterally (e.g., circumferentially and/or axially) through the panel base 118. The cooling aperture 136 may be configured as an effusion aperture. Each aperture surface 134 of FIG. 6, for example, is configured to direct a jet of cooling air into the combustion chamber 56 to film cool a downstream portion of the heat shield 82.

Referring to FIGS. 5-7, each of the quench aperture bodies 88 is formed integral with or attached to a respective one of the panel bases 118. One or more of the quench aperture bodies 88 are located laterally within a respective one of the cooling cavities 85. One or more of the quench aperture bodies 88, for example, may be arranged circumferentially between the circumferential end rails 122 and 123 of a respective one of the panels 110. One or more of the quench aperture bodies 88 may be arranged axially between the axial end and intermediate rails 120 and 124 of a respective one of the panels 110.

Each quench aperture body 88 includes an annular land 138 and an annular rim 140. The land 138 is connected to the respective panel base 118. The land 138 extends vertically from the panel base 118 to a distal land end surface 142. The land 138 extends laterally between a land outer surface 144 and a body inner surface 146, which at least partially defines a respective one of the quench apertures 72 in the combustor wall 76, 78. The body inner surface 146, for example, defines a through-hole that extends vertically through the panel 110 from a distal rim end surface 148 to the exterior surface 116.

The land outer surface 144 may have a circular cross-sectional geometry. The body inner surface 146 may also have a circular cross-sectional geometry. Of course, in other embodiments, one or more of the surfaces 144 and 146 may each alternatively have a non-circular cross-sectional geometry; e.g., an oval cross-sectional geometry, a polygonal (e.g., rectangular) cross-sectional geometry, or any geometry resulting from an overlap or connection of any of the previously mentioned shapes.

The land 138 includes one or more aperture surfaces 150. These aperture surfaces 150 may be arranged around a centerline 152 of the respective quench aperture 72. Each of the aperture surfaces 150 defines a cooling aperture 154. This cooling aperture 154 extends substantially laterally through the land 138 from the land outer surface 144 to the body inner surface 146. Of course, in other embodiments, one or more of the cooling apertures 154 may also extend vertically through the land 138.

The rim 140 is connected to the land 138. The rim 140 extends vertically from the land 138 and the land end surface 142 to the rim end surface 148. The rim 140 extends laterally between a rim outer surface 156 and the body inner surface 146. The rim outer surface 156 may have a circular cross-sectional geometry. Of course, in other embodiments, the rim outer surface 156 may alternatively have a non-circular cross-sectional geometry.

Referring to FIG. 2, the heat shield 82 of the inner wall 76 circumscribes the shell 80 of the inner wall 76, and defines an inner side of the combustion chamber 56. The heat shield 82 of the outer wall 78 is arranged radially within the shell 80 of the outer wall 78, and defines an outer side of the combustion chamber 56 that is opposite the inner side.

Referring now to FIG. 6, each quench aperture body 88 is (e.g., axially and circumferentially) aligned and mated with a respective one of the apertures 106. Each rim 140, for example, extends vertically through (or into) a respective one of the apertures 106. Each land end surface 142 may engage (e.g., slidably contact) and form a seal with the shell interior surface 98 and, thus, the shell 80.

Referring to FIG. 2, the heat shield 82 and, more particularly, each of the panels 108 and 110 may be respectively attached to the shell 80 by a plurality of mechanical attachments 158; e.g., threaded studs respectively mated with washers and nuts. The shell 80 and the heat shield 82 thereby respectively form the cooling cavities 84-86 in each combustor wall 76, 78.

Referring to FIGS. 4-6, each cooling cavity 85 is defined and extends vertically between the interior surface 98 and a respective one of the interior surfaces 112 as set forth above. Each cooling cavity 85 is defined and extends circumferentially between the circumferential end rails 122 and 123 of a respective one of the panels 110. Each cooling cavity 85 is defined and extends axially between the axial end and intermediate rails 120 and 124 of a respective one of the panels 110. In this manner, each cooling cavity 85 may fluidly couple one or more of the cooling apertures 104 in the shell 80 with one or more of the cooling apertures 136 in the heat shield 82 as well as one or more of the cooling apertures 154 in the quench aperture bodies 88.

During turbine engine operation, core air from the plenum 64 is directed into each cooling cavity 85 through respective cooling apertures 104. This core air (e.g., cooling air) may impinge against the respective panel base 118, thereby impingement cooling the panel 110 and the heat shield 82.

Some of the cooling air within each cooling cavity 85 is directed through the cooling apertures 136 into the combustion chamber 56 to film cool a downstream portion of the heat shield 82. Within each cooling aperture 136, the core air may also cool the heat shield 82 through convective heat transfer.

Some of the cooling air within each cooling cavity 85 is directed through the cooling apertures 154 into each quench aperture 72. Within each cooling aperture 154, the core air may cool the quench aperture body 88 through convective heat transfer. The cooling apertures 154 of FIGS. 8 and 9 may also direct the cooling air into each quench aperture 72 to film cool the respective body inner surface 146 and/or to induce vortices that may increase convective heat transfer within the quench aperture 72. The cooling apertures 154 of FIGS. 7-9 therefore are operable to reduce the temperature of and, thus, thermally induced stresses within the respective quench aperture body 88.

Figure 8:
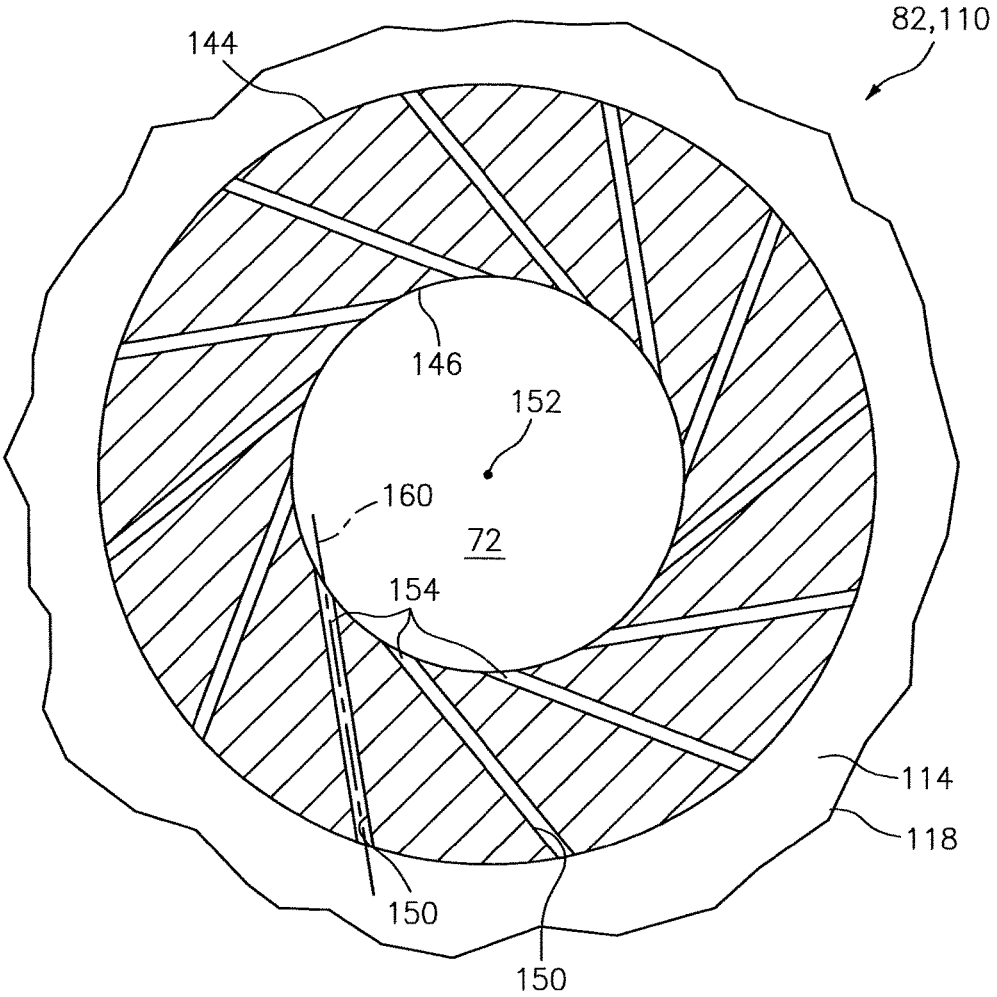
FIGS. 8 and 9 are detailed top sectional illustrations of respective portions of alternate embodiment combustor walls.

In some embodiments, referring to FIGS. 7 and 8, one or more of the cooling apertures 154 may each extend along a substantially straight centerline 160 through the quench aperture body 88. Each cooling aperture 154 of FIG. 7, for example, extends substantially radially relative to the centerline 152; e.g., the centerline 160 may be a ray of the centerline 152. In another example, each cooling aperture 154 of FIG. 8 extends substantially tangentially relative to the body inner surface 146. In other embodiments, of course, the centerline 160 of each cooling aperture 154 may follow a substantially straight trajectory other than those described above and illustrated in the drawings; e.g., the centerline 160 may be acutely offset from the body inner surface 146 by between about fifteen degrees (15°) and about eighty-five degrees (85°). The present invention, of course, is not limited to the foregoing angular examples.

Figure 9:
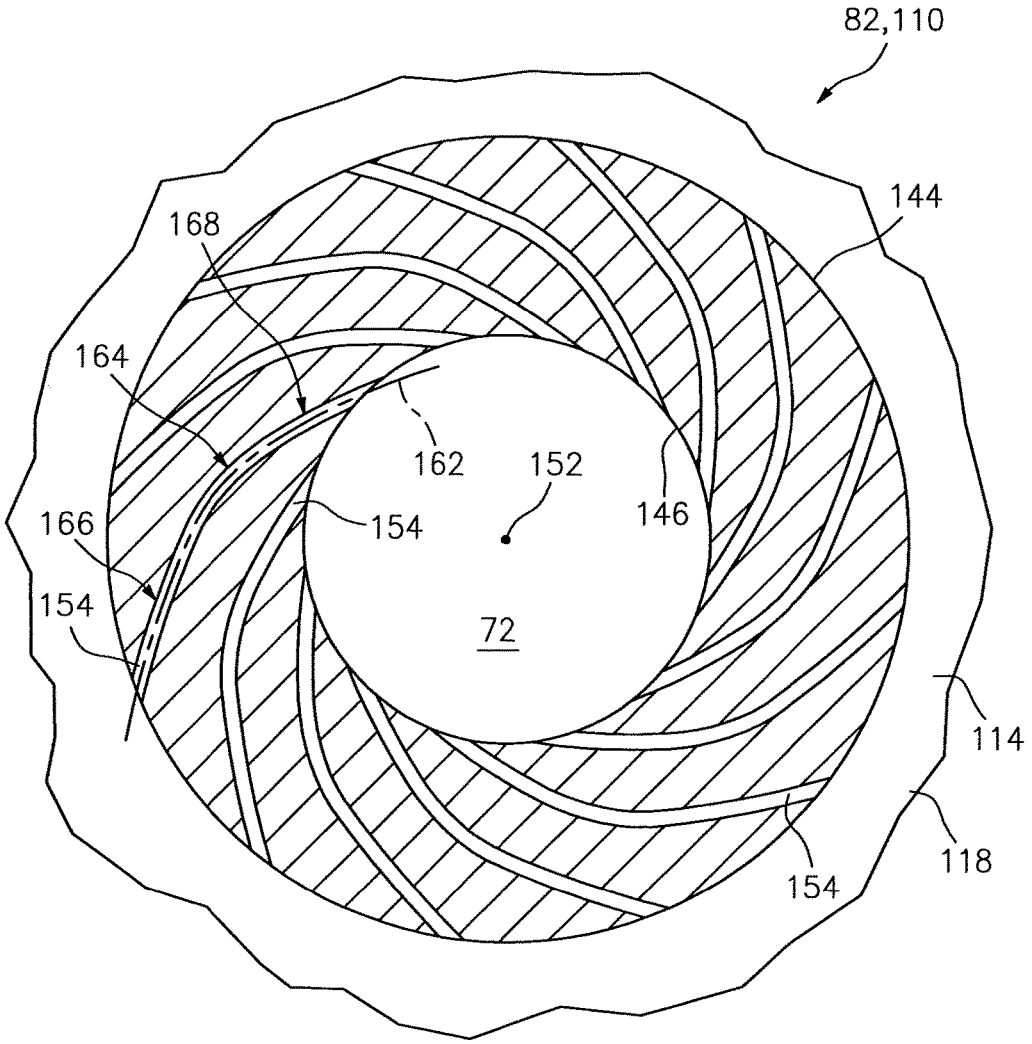

In some embodiments, referring to FIG. 9, one or more of the cooling apertures 154 may each extend along a curved and/or compound centerline 162. Each cooling aperture 154 of FIG. 9, for example, generally spirals partially (or completely) around the centerline 152. Each cooling aperture includes one or more portions such as, for example, a curved intermediate portion 164 between a straight inlet portion 166 and a straight outlet portion 168. The inlet portion 166 extends to the land outer surface 144. The outlet portion 168 extends substantially tangentially to the body inner surface 146. In other embodiments, of course, the outlet portion 168 may extend substantially radially relative to the centerline 152 or the centerline 162 of the outlet portion 168 may be acutely offset from the body inner surface 146. In addition, in other embodiments, the inlet and/or the outlet portions 166 and 168 may each be curved and/or the intermediate portion 164 may be straight.

Figure 10:
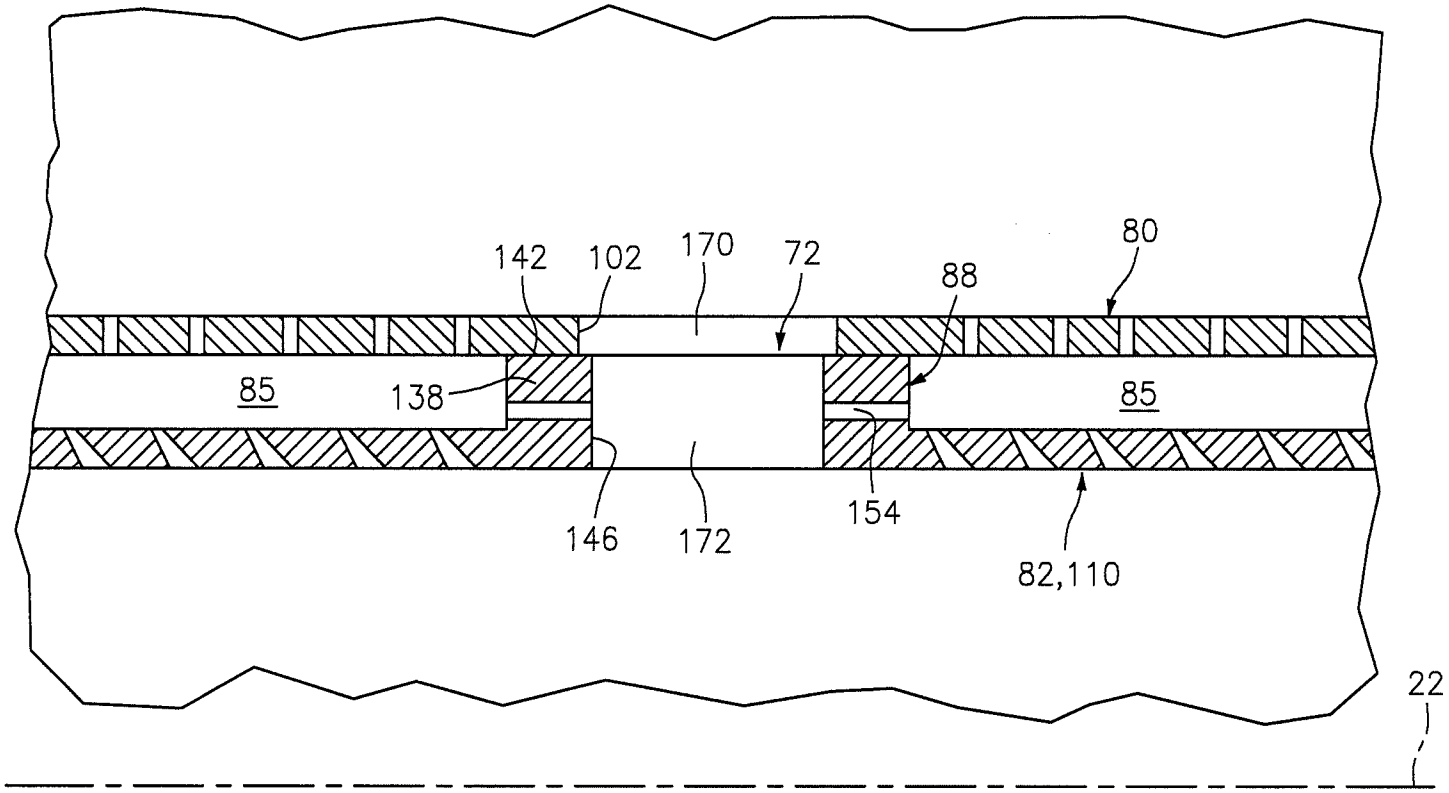
FIG. 10 is a detailed side sectional illustration of a portion of an alternate embodiment combustor wall.

In some embodiments, referring to FIG. 10, one or more of the quench aperture bodies 88 may each be configured without the rim 140 (see FIG. 6). In this manner, the surface 102 of the shell 80 may define an exterior portion 170 of a respective one of the quench apertures 72. The body inner surface 146 may faun an interior portion 172 of the respective quench aperture 72, which is vertically adjacent and fluidly coupled with the exterior portion 170.

The terms "forward", "aft", "inner", "outer", "radial", circumferential" and "axial" are used to orientate the components of the turbine engine assembly 60 and the combustor 62 described above relative to the turbine engine 20 and its centerline 22. One or more of these turbine engine components, however, may be utilized in other orientations than those described above. The present invention therefore is not limited to any particular spatial orientations.

The turbine engine assembly 60 may be included in various turbine engines other than the one described above. The turbine engine assembly 60, for example, may be included in a geared turbine engine where a gear train connects one or more shafts to one or more rotors in a fan section, a compressor section and/or any other engine section. Alternatively, the turbine engine assembly 60 may be included in a turbine engine configured without a gear train. The turbine engine assembly 60 may be included in a geared or non-geared turbine engine configured with a single spool, with two spools (e.g., see FIG. 1), or with more than two spools. The turbine engine may be configured as a turbofan engine, a turbojet engine, a propfan engine, or any other type of turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention.

Accordingly, the present invention is not to be restricted except in light of the attached claims and their equivalents.

What is claimed is:

1. An assembly for a turbine engine, the assembly comprising:

a combustor wall including a shell, a heat shield and an annular body extending through the combustor wall;

wherein the annular body at least partially defines a quench aperture along a centerline through the combustor wall;

wherein the annular body defines a first cooling aperture fluidly coupled between a cooling cavity and the quench aperture, the cooling cavity being defined between the shell and the heat shield;

wherein the first cooling aperture extends along a curved centerline through a sidewall of the annular body between an inlet of the first cooling aperture and an outlet of the first cooling aperture; and wherein the curved centerline, from the inlet to the outlet, lies in a plane which is substantially perpendicular to the centerline of the quench aperture;

wherein the first cooling aperture is one of a plurality of first cooling apertures defined by the annular body, the plurality of first cooling apertures being distributed about an entire circumference of the annular body, and each of the first cooling apertures is fluidly coupled between the cooling cavity and the quench aperture.

2. The assembly of claim 1, wherein the outlet of each first cooling aperture extends substantially tangentially relative to a surface of the annular body that defines the quench aperture.

3. The assembly of claim 1, wherein the curved centerline of each respective first cooling aperture is acutely angled relative to a surface of the annular body that defines the quench aperture at the respective outlet of the respective first cooling aperture.

4. The assembly of claim 1, wherein the annular body includes an annular land and an annular rim;

the annular land extends from the heat shield and engages the shell; and the annular rim extends from the annular land into or through an aperture defined by the shell.

5. The assembly of claim 4, wherein the annular land defines the plurality of first cooling apertures.

6. The assembly of claim 1, wherein the shell includes a surface that further defines the quench aperture through the combustor wall.

7. The assembly of claim 1, wherein the cooling cavity fluidly couples one or more second cooling apertures defined by the shell with the plurality of first cooling apertures and one or more third cooling apertures defined by the heat shield.

8. The assembly of claim 1, wherein the heat shield includes a plurality of panels that are attached to the shell, and the annular body is connected to one of the panels.

9. The assembly of claim 1, wherein the combustor wall is a first combustor wall, the assembly further comprising:

a second combustor wall; and a combustor bulkhead that extends between the first combustor wall and the second combustor wall;

wherein the heat shield, the second combustor wall and the combustor bulkhead define a combustion chamber.

10. An assembly for a turbine engine, the assembly comprising:

a combustor wall including a shell, a heat shield and an annular body extending through the combustor wall;

wherein the annular body at least partially defines a quench aperture along a centerline through the combustor wall;

wherein the annular body defines a first cooling aperture fluidly coupled between a cooling cavity and the quench aperture, the cooling cavity being defined between the shell and the heat shield;

wherein the first cooling aperture extends along a curved centerline;

wherein the curved centerline is configured such that the first cooling aperture continuously moves radially closer to the centerline of the quench aperture as the first cooling aperture extends from an inlet of the first cooling aperture to an outlet of the first cooling aperture; and wherein the first cooling aperture is one of a plurality of first cooling apertures defined by the annular body, the plurality of first cooling apertures being distributed about an entire circumference of the annular body, and each of the first cooling apertures is fluidly coupled between the cooling cavity and the quench aperture.

11. The assembly of claim 10, wherein the outlet of each first cooling aperture extends substantially tangentially relative to a surface of the annular body that defines the quench aperture.

12. The assembly of claim 10, wherein the curved centerline of each respective first cooling aperture is acutely angled relative to a surface of the annular body that defines the quench aperture at the respective outlet of the respective first cooling aperture.

13. The assembly of claim 10, wherein the annular body includes an annular land and an annular rim;

the annular land extends from the heat shield and engages the shell; and the annular rim extends from the annular land into or through an aperture defined by the shell.

14. The assembly of claim 13, wherein the annular land defines the plurality of first cooling apertures.

15. The assembly of claim 10, wherein the shell includes a surface that further defines the quench aperture through the combustor wall.

16. The assembly of claim 10, wherein the cooling cavity fluidly couples one or more second cooling apertures defined by the shell with the plurality of first cooling apertures and one or more third cooling apertures defined by the heat shield.

17. The assembly of claim 10, wherein the heat shield includes a plurality of panels that are attached to the shell, and the annular body is connected to one of the panels.

18. The assembly of claim 10, wherein the combustor wall is a first combustor wall, the assembly further comprising:

a second combustor wall; and a combustor bulkhead that extends between the first combustor wall and the second combustor wall;

wherein the heat shield, the second combustor wall and the combustor bulkhead define a combustion chamber.

19. An assembly for a turbine engine, the assembly comprising:

a combustor wall including a shell, a heat shield and an annular body extending through the combustor wall;

wherein the annular body at least partially defines a quench aperture along a centerline through the combustor wall;

wherein the annular body defines a first cooling aperture fluidly coupled between a cooling cavity and the quench aperture, the cooling cavity being defined between the shell and the heat shield;

wherein the first cooling aperture extends along a compound centerline;

wherein the compound centerline is configured such that the first cooling aperture continuously moves radially closer to the centerline of the quench aperture as the first cooling aperture extends from an inlet of the first cooling aperture to an outlet of the first cooling aperture; and wherein the first cooling aperture is one of a plurality of first cooling apertures defined by the annular body, the plurality of first cooling apertures being distributed about an entire circumference of the annular body, and each of the first cooling apertures is fluidly coupled between the cooling cavity and the quench aperture.

* * * * *